United States Patent [19]

Moskowitz

[11] 4,175,363

[45] Nov. 27, 1979

[54] FOOTERS FOR SUPPORTING MONUMENTS FOR CEMETERIES AND THE LIKE

[76] Inventor: Benson Moskowitz, 221 Edgehill Dr., Havertown, Pa. 19083

[21] Appl. No.: 860,297

[22] Filed: Dec. 14, 1977

[51] Int. Cl.[2] ..... E02D 27/00

[52] U.S. Cl. ..... 52/294; 52/103; 52/593; 52/610

[58] Field of Search ..... 52/103, 294, 79.1, 593, 52/236.3, 585, 610, 227, 136, 79.2, 79.3, 79.4, 142, 250, 251, 596, 79.14, 125, 79.9

[56] References Cited

U.S. PATENT DOCUMENTS

| | | | |
|---|---|---|---|
| 1,362,882 | 12/1920 | McGair | 52/142 |
| 1,719,224 | 7/1929 | Haase | 52/125 X |
| 2,373,409 | 4/1945 | Myer | 52/227 X |
| 4,019,294 | 4/1977 | Bosico etal. | 52/103 |
| 4,040,227 | 8/1977 | Van der Lely et al. | 52/79.1 X |

FOREIGN PATENT DOCUMENTS

| | | | |
|---|---|---|---|
| 239508 | 8/1964 | Austria | 52/142 |
| 812960 | 7/1949 | Fed. Rep. of Germany | 52/128 |
| 1129524 | 10/1968 | United Kingdom | 52/79.14 |
| 1158708 | 7/1969 | United Kingdom | 52/79.1 |

*Primary Examiner*—Carl D. Friedman
*Attorney, Agent, or Firm*—Frailey & Ratner

[57] ABSTRACT

A stable, multi-component footer is provided for supporting markers, memorials, gravestones and/or monuments in cemeteries and the like. The footer forms a hollow, generally rectangular structure for installation within a grave. It includes a pair of integral vertical side members which are spaced apart sufficiently to accommodate a casket therebetween. An upper horizontal support member extends between and is connected to the upper ends of the two side members, to provide a support plate for the monument. When the footer is assembled, its components are secured detachably by locking means comprising engageable complementary male and female elements. The locking means provides stability to the assembled footer, as well as ease of assembly. In its preferred form, the footer comprises two separate, complemental, interchangeable L-shaped components, one component being in the form of an inverted L and the other being in the form of an upright L. When the two identical L-shaped components are assembled, their respective distal ends are detachably engaged by locking means comprising complemental tongue and groove constructions, or complemental pin and hole constructions, or a combination thereof.

20 Claims, 10 Drawing Figures

FOOTERS FOR SUPPORTING MONUMENTS FOR CEMETERIES AND THE LIKE

DEFINITIONS

The terms "markers", "memorials" and "gravestones" as used herein shall mean cemetery monuments having a concentrated weight ranging up to approximately one ton on a single gravesite.

The term "hollow, generally rectangular structure" as used herein shall include structures having horizontally spaced vertical side members and at least one horizontal member extending between the side members, to provide an inverted U-shaped configuration, as well as structures having horizontally spaced vertical side members and vertically spaced horizontal top and bottom members.

BACKGROUND OF THE INVENTION

This invention pertains to means for supporting markers, memorials, gravestones and/or monuments in cemeteries and the like, particularly where vaults or liners for encasement of a casket are not used.

The erection of monuments on a grave, after it has been back filled, encounters a variety of problems. If the monument is supported on the fill dirt too soon after the grave has been back filled, the fill dirt is likely to settle several times, changing the contour of the ground and thereby causing the monument to shift or sink, or even topple. Delay in installing monuments to permit the fill dirt to settle usually is not a satisfactory solution, particularly where a vault or liner is not used to encase the casket. Moreover, caskets are made of wood or metal and gradually deteriorate in the ground, thereby causing the dirt above the casket to settle several times again. Such displacement of the soil above a casket can occur at any time. Hence, there is no assurance that merely delaying the erection of a monument to permit the fill dirt to settle will eliminate the problem of the sinking, shifting or toppling of a monument. In addition, installation of monuments in the winter months generally has not been practical. Poured concrete usually is employed in preparing monument foundations, and should not be poured below about 45° F.

To obviate these problems, various attempts have been made to provide supports or foundations for cemetery monuments. Such supports are designed to rest on the bottom of the grave, and to extend upwardly and around the interred casket. They usually include a footer having a pair of spaced vertical legs which straddle the casket. A common type of footer for a cemetery monument foundation is the pier type consisting of two separate vertical legs and a separate horizontal cross member or slab extending over the casket and supported by the legs. The legs usually comprise two separate vertical slabs standing on end, or several bricks or cement blocks piled vertically, end on end. Pier type footers normally are used to support poured concrete, which fills the gap between the top of the cross member and the ground surface adjacent the grave. In such installations, the monument rests on the poured concrete supported by the footer. Such monument foundations are highly unstable, because of their tendency to wobble, and therefore are lacking in safety. Examples of more rigid cemetery monument supports are illustrated by Swiss Pat. No. 217,791 (1942), German Pat. No. 812,906 (1951) and U.S. Pat. No. 4,019,294 (1977). The support arrangements of those patents extend upwardly from the bottom of the grave, and terminate in a monument support base generally level with the ground surface. While use of such supports avoids the dirt settling problems inherent in a grave, they do not provide a satisfactory solution. The major drawback of such supports is their lack of stability, which renders them unsafe. Also difficulty may be encountered in lowering a casket into a grave to be positioned properly relative to the two vertical legs of such foundation.

Because supports or foundations of the type illustrated in those patents are relatively unstable, they are subject to substantial displacement, or even collapse, if they are jarred by natural causes, or by digging equipment being used in an adjacent grave. If such equipment should strike the support, it could be dislodged, causing the monument which it supports to fall and possibly injure personnel in the area. At the very least, if such accident should occur, and the support be dislodged, the monument would be displaced or tilted, thereby necessitating adjustment and/or repair.

The marker support of U.S. Pat. No. 4,019,294 endeavors to overcome the problems inherent in the earlier arrangements illustrated in the Swiss and German patents aforesaid. But the footer of that United States patent is lacking in sufficient stability, and hence is readily susceptible to serious displacement, due to the fact that its vertical side members are not integral, but are separated at their mid-points, their weakest and most vulnerable support areas. The breaks in the side members of that footer occur at the attentuated ends of the four vertical legs forming the side members. The heavier the monument to be supported, the greater the risk that such footer is likely to crack or break in the areas of the joints formed at the mid-points of the vertical side members, rendering the entire structure consisting of the foundation and its monument vulnerable to collapse. The footer of that patent suffers, also, from another deficiency which arises during the lowering of a casket into the grave. Because the lower component of that footer is U-shaped, with two upstanding legs, the casket, when it is lowered, may strike one or the other of those legs and be tilted about its longitudinal axis. Such mishap not only may require raising and re-lowering of the casket into the grave, but is rife with the possibility that the casket could be tilted sufficiently for its lid to open, if unsecured, with the result that the cadaver therein might fall out.

SUMMARY OF THE INVENTION

It is the primary object of this invention to provide a footer for supporting markers, memorials, gravestones and/or monuments in cemeteries or the like, particularly where vaults or liners are not used, which overcome the problems aforesaid. More particuarly, a primary object of this invention is to provide a footer for installation in a grave for supporting monuments which has capacity for ease of assembly, and which incorporates enhanced stability following its assembly in a grave at the time of interment, thereby providing maximum safety.

A further object of the invention is to provide a footer for supporting monument foundations in cemeteries which is adaptable for installation within a grave, and which embodies sufficient stability to ensure against the toppling of the monument which it supports if it is bumped or jarred, even by heavy equipment digging in an adjacent grave.

A further object of the invention is to provide a footer for supporting monuments for cemeteries which is adaptable to permitting the monument to be erected immediately following back filling of the grave.

A further object is to provide an improved, highly stable footer for supporting markers for cemeteries and the like which is readily adaptable to be installed during the winter months, or to be installed in wet, mushy, soft or granular soil, while providing improved stability for support of a marker.

A further object of the invention is to provide a highly stable, multi-component footer for supporting markers for cemeteries and the like which forms a hollow, generally rectangular structure, and which incorporates detachable locking means to permit the ready assembly and disassembly of the footer, without impairing its stability.

Other objects and advantages of this invention will become readily apparent from the following description of several proposed embodiments thereof, the same being illustrated in the accompanying drawing.

DETAILED DESCRIPTION OF THE INVENTION

Figure 1:
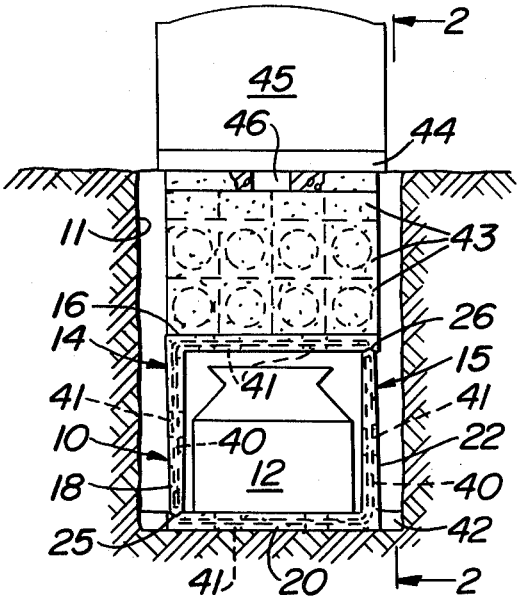
FIG. 1 is a view in front elevation of a preferred footer embodying this invention, the footer being shown assembled and in use in a grave.
Figure 3:
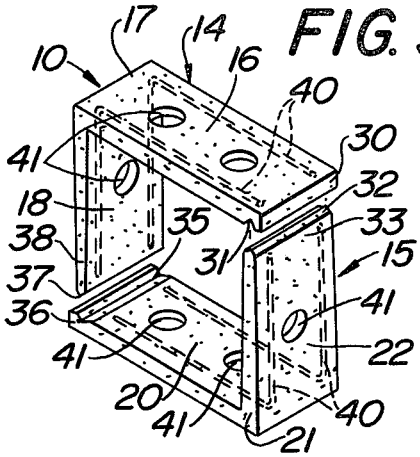
FIG. 3 is an enlarged exploded view in perspective showing the two components of the footer illustrated in FIGS. 1 and 2.
Figure 2:
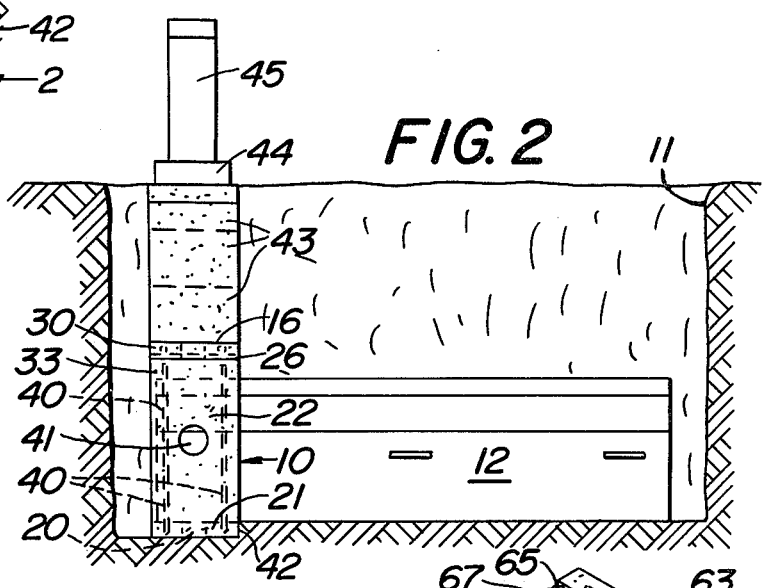
FIG. 2 is a view in side elevation showing the grave and the footer illustrated in FIG. 1.

In FIGS. 1–3 of the drawing there is illustrated a preferred embodiment of this invention forming a hollow, generally rectangular footer 10 for installation in a grave 11, which has been excavated to accommodate a casket 12. As best illustrated in FIG. 3, the footer 10 is composed of two separate, complemental, interchangeable L-shaped components 14, 15, component 14 being in the form of an inverted L and component 15 being in the form of an upright L. Component 14 comprises upper horizontal support member 16 integrally joined at its proximal end 17 to vertical side member 18. Similarly, component 15 is constituted by a lower horizontal member 20 integrally joined at its proximal end 21 to a second vertical side member 22.

As illustrated in FIGS. 1 and 2, when the footer 10 is assembled in a grave 11, its vertical side members 18, 22 are spaced apart horizontally by a distance sufficient to accommodate therebetween the casket 12. In like manner, the upper horizontal support member 16 and the lower horizontal member 20 are spaced apart vertically by a distance sufficient to accommodate the casket. The upper horizontal support member 16 is located proximate the upper surface of the casket 12. When the two L-shaped components 14, 15 of the footer 10 are assembled, they are detachably secured by diagonally spaced locking means 25, 26 disposed at the respective distal ends of the two components. Each locking means 25, 26 comprises engageable complementary male and female elements designed to provide stability to the footer 10, when its components or members are assembled. The detachable locking means 25, 26 further provide the footer 10 with capacity for ease of assembly and disassembly.

A preferred form of detachable locking means, comprising a tongue and groove construction or arrangement, is illustrated in FIG. 3. More specifically, there is formed in the lower surface of the distal end 30 of the upper horizontal support member 16 an elongated groove 31 designed to engage detachably with a complemental elongated projection or tongue 32 formed along the distal end 33 of the vertical side member 22. Similarly, an elongated groove 35 is formed in the upper surface of the distal end 36 of the lower horizontal member 20, and is adapted to be engaged detachably with a complemental elongated projection or tongue 37 formed along the distal end 38 of the vertical side member 18. It will be understood that, in the embodiment of the footer 10 illustrated in FIGS. 1–3, the detachable locking means 25 is constituted by the complemental tongue and groove elements 37, 35, and that the detachable locking means 26 is constituted by the complemental tongue and groove elements 32, 31.

Preferably, the interchangeable L-shaped components 14, 15 are formed of molded precast concrete, and are provided with two or more generally L-shaped metal reinforcing rods 40 for increased strength. One or more holes 41 may be formed in the vertical and horizontal members 16, 18, 20, 22 of the footer 10 to reduce the weight of its components, to furnish convenient hand gripping means for carrying the components and to provide water drainage means when the footer is assembled and installed in a grave 11.

Figure 7:
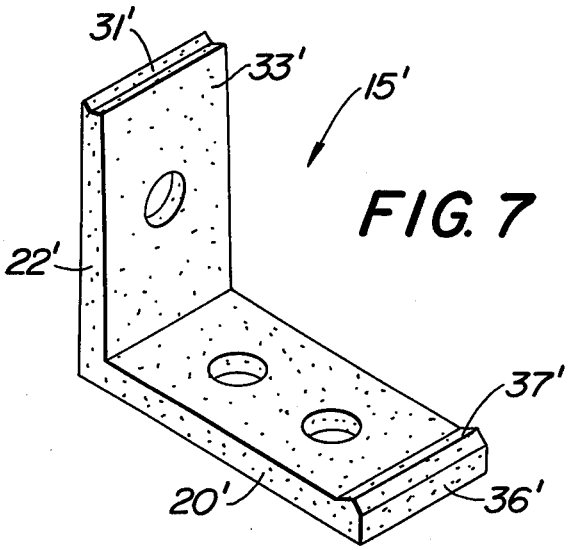
FIGS. 7–10 illustrate modifications of the embodiment of the footer of this invention illustrated in FIGS. 1–3.
Figure 8:
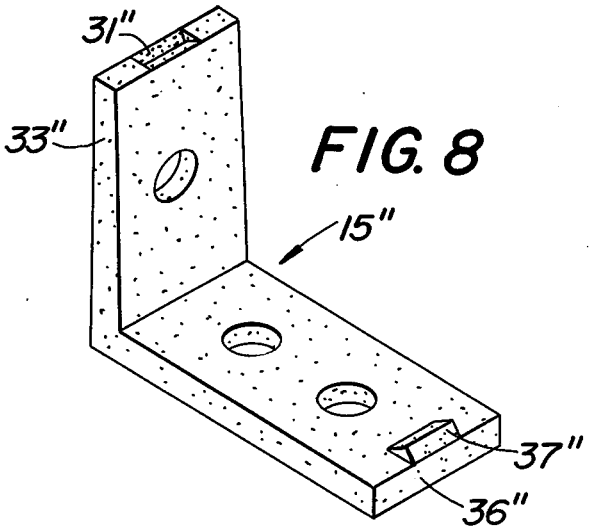
Figure 9:
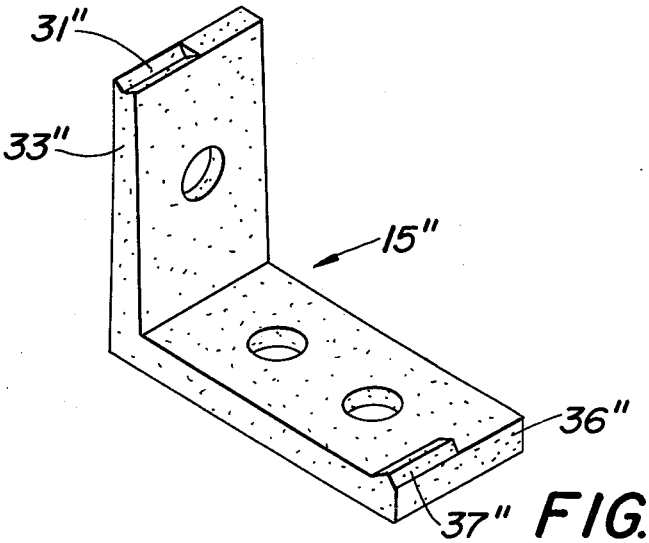

If desired, the tongue and groove locking means illustrated in FIGS. 1–3, for detachably securing the footer 10 in assembled condition, may be modified as illustrated in FIGS. 7–9. In FIG. 7, an elongated upstanding projection or tongue 37' is formed along the distal end 36' of the lower horizontal member 20' of the L-shaped footer component 15'. An elongated groove 31' is formed along the upper end portion or distal end 33' of the vertical side member 22'. As illustrated in FIGS. 8 and 9, the projection or tongue 37'' may be of abbreviated length, and the groove may be shortened into the form of a notch 31''. The tongues 37'' and notches 31'' may be selectively located relative to the distal ends 36'' and 33'', respectively, of the L-shaped footer components 15''. It will be understood, of course, that the tongues and grooves illustrated in FIGS. 7–9 are designed for detachable engagement with complemental grooves and tongues formed in interchangeable L-shaped footer components (not shown) which mate with components 15' or 15''.

Although the cross-sections of the tongue and groove constructions illustrated in FIGS. 1–3 and 7–10 are shown to be of V-shaped configuration, it will be understood that any alternate form of cross-sectional configuration is within the scope of this invention. For example, the complemental cross-sectional configuration of the tongues and grooves of the detachable locking means 25, 26 may be curved, or rectangular, if desired.

The installation and assembly of footer 10 in grave 11 is as follows: After the grave 11 has been opened, the upright L-shaped component 15 is placed in the bottom of the grave at one end thereof, in the position shown in FIGS. 1 and 2. Thereafter, the casket 12 is lowered into the grave 11, to rest on the bottom thereof and on the upper surface of the lower horizontal member 20, as illustrated in FIG. 2. The inverted L-shaped component 14 then is installed, as illustrated in FIG. 1, and the detachable locking means 25, 26 are engaged to interlock the two footer components 14, 15. After this has been done, the grave may be back filled and tamped in the usual manner, to a level flush with the upper surface of the upper horizontal support member 16 of the footer 10. Thereupon, the usual cement block 43 may be mounted in place on support member 16, and then an upper plate or cap 44 provided, preparatory to the installation of the marker 45. The grave 11 then is back filled to ground level. Preferably, the blocks 43 comprise conventional, hollow cement blocks, and the plate 44 comprises a stone or concrete slab having one or more water drainage holes 46 formed therein. To facilitate water drainage, the blocks 43 mounted on the upper horizontal support member 16 may be disposed so that their hollows are vertical.

If desired, the grave 11 initially may be back filled and tamped to ground level, completely covering the footer 10. At a later time, the dirt above the support member 10 may be excavated preparatory to installing the marker. If this latter procedure is followed, the use of the cement blocks 43 and plate 44 may be dispensed with, and poured concrete may be utilized to fill the gap between the upper surface of the horizontal support member 16 of the footer 10 and the lower surface of the marker 45, preferably when the temperature is about 45° F.

As illustrated in FIGS. 1 and 2, a shallow trench 42 may be provided in the bottom of the grave 11 to accommodate the lower horizontal member 20 of the footer 10. Preferably, the depth of the trench 42 is substantially equal to the thickness of member 20, whereby the upper surface of that member is generally flush with the level of the bottom of the grave. A trench 42 may be utilized where the soil in the bottom of the grave is hard, compact or generally firm.

However, if the soil in the bottom of the grave 11 is wet and mushy, or soft, or granular, or otherwise of a condition whereby the footer 10 may settle into the soil, the trench 42 may be omitted. With such soft soils, there is a possibility that loose or flowable material may enter the groove 35 in lower horizontal member 20, to partially or wholly clog it, thereby impairing the engagement between groove 35 and its complemental tongue 37 formed along the lower end portion of vertical side member 18. In such a situation, the use of footers having interchangeable L-shaped components of the types illustrated in FIGS. 7–9 are preferred. In those arrangements, because the grooves are formed in the end portions of the vertical side members, rather than in the lower horizontal members, clogging of the grooves is avoided.

Preferably, the interchangeable L-shaped components 14, 15, 15', 15'' of the footers 10 are precast in metal molds. To facilitate removal of the cast components from the mold, their vertical side members may be of tapered configuration, as illustrated in FIGS. 1, 2, 7, 8 and 9.

Figure 4:
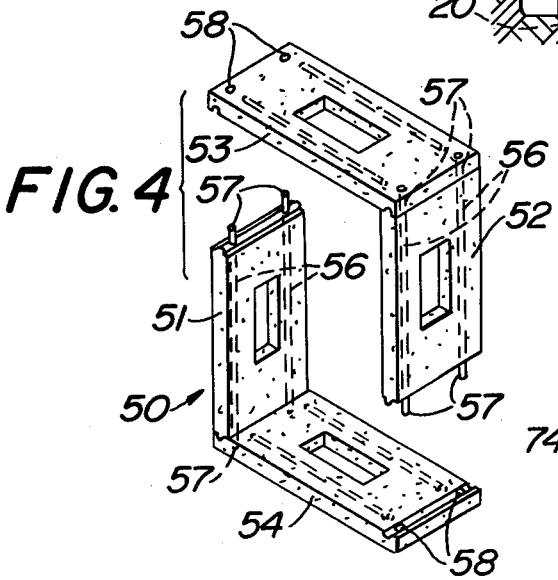
FIGS. 4–6 illustrate in perspective additional embodiments of the footer of this invention.
Figure 10:
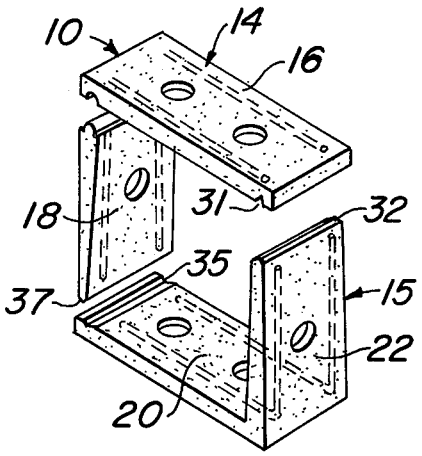

In the embodiment illustrated in FIG. 4, the footer 50 is composed of four separate components consisting of two horizontally spaced vertical side members 51, 52 and two vertically spaced horizontal members 53, 54. A pair of horizontally spaced, vertically extending, metal reinforcing rods 56 are disposed internally of each of the side members 51, 52. The rods 56 have upper and lower protruding ends 57 extending beyond the upper and lower portions of the side members 51, 52. The protruding ends 57 are equivalent to pins, and are designed to engage within complemental holes 58 disposed in the horizontal members 53, 54, to provide detachable locking means. The detachable locking means for the footer 50 may include in place of, or in addition to, the pin 57 and hole 58 arrangement a tongue and groove construction. In the arrangement shown in FIG. 4, elongated tongues or projections extend from the upper and lower end portions of the side members 51, 52 and mate with spaced, complemental, elongated grooves formed in the opposing faces of the horizontal members 53, 54. The vertical side members 51, 52 of the footer 50 straddle the casket, which rests on the upper surface of the lower horizontal member 54 in the manner illustrated in FIG. 2. The upper horizontal support member 53 is located above and closely adjacent the casket. If desired, the lower horizontal member 54 may be formed integrally with one or the other of the vertical side members 51, 52 to provide a unitary L-shaped member similar to component 15 of FIGS. 1–3. Such arrangement is depicted in FIG. 10, as a modification of FIG. 3. Alternatively, the upper horizontal member 53 may be formed integrally with either side member 51 or 52 to provide a unitary L-shaped member similar to component 14 of FIGS. 1–3.

Figure 5:
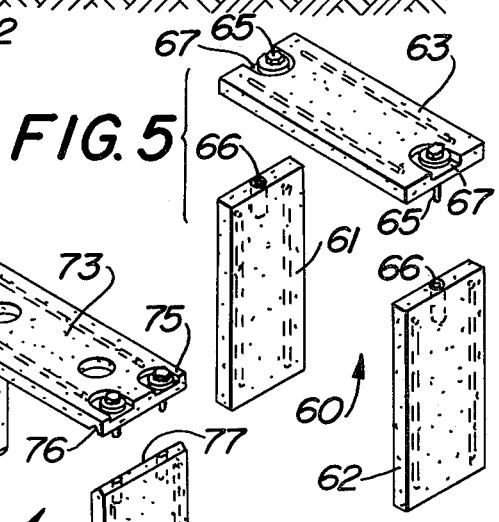

The modified footer 60 illustrated in FIG. 5 comprises three separate components consisting of two horizontally spaced vertical side members 61, 62 and a horizontal support member 63. The three components of footer 60 are detachably secured by locking means comprising pins 65 which pass through horizontally spaced holes (not shown) in the horizontal member 63, and engage within holes 66 formed in the upper end portions of the vertical side members 61, 62. If desired, the pins 65 may comprise threaded bolts which pass through the spaced holes in the horizontal member 63 and engage threadingly with threads formed internally of the holes 66. In this latter construction, it is preferred that the holes 66 be provided with internally threaded inserts (not shown) of conventional construction. The upper surface of the horizontal member 63 may be provided with clearances 67 adjacent the spaced holes formed therein, so as to permit ready access to the upper ends of the pins or threaded bolts 65. The vertical side members 61, 62 of the footer 60 straddle the casket, and their lower end portions are adapted to rest on the bottom of the grave.

Figure 6:
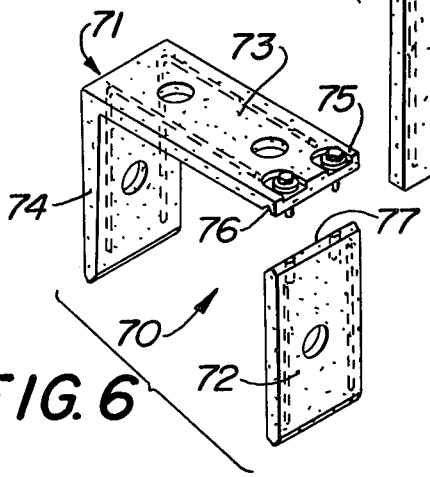

In the modification illustrated in FIG. 6, the footer 70 is constituted by an inverted L-shaped component 71 detachably engageable with a separate vertical side member 72. The L-shaped component 71 is of similar construction to the L-shaped components illustrated in FIG. 3, and includes a horizontal support member 73 integrally joined at its proximal end to a vertical side member 74. The distal end 75 of the horizontal member 73 of component 71 may be provided with an elongated groove 76 for engagement with a complemental elongated projection or tongue 77 disposed along the upper end portion of the vertical side member 72. In place of, or in addition to, the tongue 77 and groove 76 construction, the detachable locking means for the footer 70 may be constituted by one or more pin-and-hole means of the type illustrated in FIG. 5.

To enhance the stability of the footer of this invention, the upper ends of the two vertical side members preferably terminate at locations adjacent the upper surface of the casket, and the upper horizontal support member extends linearly between and overlies the upper end portions of the vertical side members.

As will be readily observed, the locking means in all embodiments of this invention, which detachably secure the members or components of the footers, comprise complementary male and female elements which are readily engageable and disengageable, to also provide stability to the footer when assembled, and to permit ease of assembly and disassembly of its various members. Should a footer embodying this invention be struck or bumped by heavy equipment, or be jarred by natural or other causes, the displacement of the separate members relative to each other is minimal. As a result, stability of the footer is greatly enhanced, thereby providing complete safety for personnel who may be working in the area adjacent the grave particularly when digging in or opening an adjacent grave.

The complemental locking elements not only permit ease of assembly of the footer in a grave, but also permit ease of assembly and disassembly in handling, storage and shipment of footers in quantity, thereby reducing inventory and delivery costs.

As explained previously, the primary use of the footer of this invention is to support cemetery monuments above graves where vaults or liners are not used to encase the casket. Usually, in such installations, the footer is installed so as to straddle the casket, in the manner illustrated in FIG. 2. However, it will be obvious to anyone experienced in the installation, erection and maintenance of cemetery monuments that the footer of this invention readily lends itself for use in supporting monuments above graves where vaults or liners have been used to encase the casket. In such event, the footer preferably would not straddle the vault or liner, but either would be disposed immediately above it, or would be located proximate to one end thereof. Even where a vault or liner is not used, it is not always necessary, in the use of the invention, that the footer straddle the casket. Rather, it may be disposed proximate to one end thereof for support of the monument. In the event of use with a vault or liner, or use with a casket where it does not straddle the casket, the footer may be placed within a separate hole adjacent the open grave, whereby it is permitted to rest on undisturbed ground. As will be obvious, any of the embodiments of the invention illustrated in the drawing are suitable for adaptation to the foregoing alternate uses of the invention.

Although several preferred embodiments of this invention have been shown and described herein for the purpose of illustration, as required by Title 35 U.S.C. § 112, it is to be understood that various changes, modifications and alterations may be made thereto without departing from the spirit and utility of the invention, or the scope thereof as set forth in the appended claims. In all embodiments, the upper horizontal support member extends linearly between the vertical side members and is disposed proximate or closely adjacent the casket.

I claim:

1. A stable, multi-component footer for supporting monuments for cemeteries and the like, said footer forming a hollow, generally rectangular structure for installation within a grave containing a casket and having capacity for ease of assembly, said footer including (a) a pair of horizontally spaced, vertical side members, said side members each being integral and being spaced apart sufficiently to accommodate a casket therebetween, (b) said side members each having upper end portions and lower end portions, said upper end portions terminating at locations adjacent the upper surface of a casket deposited in the grave and said lower end portions terminating adjacent the bottom of the grave, (c) a horizontal support member extending between the two side members and connected to the spaced upper ends of said side members, said horizontal support member being located proximate the upper surface of the casket, (d) said horizontal support member and one of the vertical side members comprising an integral L-shaped member, said horizontal support member having a proximal end joined integrally to the upper end portion of its said integral side member, and (e) locking means detachably securing the upper end of the second side member to the horizontal support member, (f) said locking means comprising engageable complementary male and female elements adapted to provide stability to the footer when the members thereof are assembled.

2. The footer of claim 1, wherein the detachable locking means comprises a groove formed in the distal end of the horizontal support member and a complemental projection formed along the upper end portion of the second side member.

3. The footer of claim 1, wherein the detachable locking means comprises a projection formed adjacent the distal end of the horizontal support member and a complemental groove formed along the upper end portion of the second side member.

4. The footer of claim 1, wherein the detachable locking means comprises:

(i) a hole formed in the upper end portion of the second side member, (ii) a hole formed in the distal end of the horizontal support member and (iii) a pin adapted to pass through the hole in the distal end of the horizontal support member and engage within the hole in the second side member.

5. The footer of claim 1, wherein the detachable locking means comprises:

(i) an internally threaded hole formed in the upper end portion of the second side member, (ii) a hole formed in the distal end of the horizontal support member and (iii) a threaded bolt adapted to pass through the hole in the distal end of the horizontal support member and engage threadingly with the threads in the hole in the second side member

6. The footer of claim 1, further including a second horizontal member extending between the two side members and located below the aforesaid horizontal support member, said lower horizontal member being connected to the spaced lower end portions of the side members.

7. The footer of claim 6, comprising two separate, complemental L-shaped components, one said component being in the form of an inverted L and the other component being in the form of an upright L, wherein (a) the inverted L-shaped component comprises the upper horizontal support member integrally joined to one of the vertical side members, (b) the upright L-shaped component comprises the lower horizontal member integrally joined to the other vertical side member and (c) the locking means detachably secures each side member of one of the L-shaped components to the horizontal member of the other L-shaped component.

8. The footer of claim 7, wherein the horizontal and vertical members of the L-shaped components have distal ends, and wherein (a) the detachable locking means comprises two separate, complemental tongue and groove means, (b) the grooves comprising slots formed in the distal ends of the horizontal members of the L-shaped components and (c) the tongues comprising projections extending from the distal ends of the side members of the L-shaped components.

9. The footer of claim 7, wherein the horizontal and vertical members of the L-shaped components have distal ends, and wherein (a) the detachable locking means comprises two separate, complemental tongue and groove means, (b) the tongues comprising projections extending from the distal ends of the horizontal members of the L-shaped components, and (c) the grooves comprising slots formed in the distal ends of the side members of the L-shaped components.

10. The footer of claim 1, further including at least one hole formed in each member to provide hand grips for carrying the components of the footer and to provide water drainage means when the footer is installed in a grave.

11. A stable, multi-component footer for supporting monuments for cemeteries and the like, said footer forming a hollow, generally rectangular structure for installation with a grave containing a casket and having capacity for ease of assembly, said footer including (a) a pair of horizontally spaced vertical side members, said side members each being integral and being spaced apart sufficiently to provide stability for support of a monument, (b) said side members each having upper ends and lower ends, said lower ends terminating at locations above the bottom of the grave, (c) a horizontal support member extending linearly between and overlying the two side members and connected to the spaced upper ends of said side members, said horizontal support member being disposed closely adjacent a casket located in the grave, (d) a second horizontal member extending between and underlying the two side members and connected to the spaced lower ends of said side members, (e) at least one of said horizontal members and one of said vertical side members comprising an integral L-shaped component, and (f) locking means detachably securing the upper end of at least one of the side members to the upper horizontal support member, (g) said locking means comprising engageable complementary male and female elements adapted to provide stability to the footer when the members thereof are assembled.

12. The footer of claim 11, wherein the detachable locking means comprises an elongated groove formed in the horizontal support member and a complemental elongated tongue formed along the upper end portion of at least one of the vertical side members.

13. The footer of claim 11, wherein the detachable locking means comprises an elongated tongue formed on the horizontal support member and a complemental elongated groove formed along the upper end portion of at least one of the vertical side members.

14. The footer of claim 11, wherein the detachable locking means comprises a tongue formed on the horizontal support member and a complemental notch formed in the upper end portion of at least one of the vertical side members.

15. The footer of claim 11, wherein the detachable locking means includes a vertical pin adapted to extend through a hole in the horizontal support member and engage within a hole formed in the upper end portion of a vertical side member.

16. The footer of claim 11, wherein the detachable locking means includes a vertical pin extending upwardly from at least one vertical side member, for engagement within a hole formed in the horizontal support member.

17. A stable, multi-component footer for supporting monuments for cemeteries and the like, said footer forming a hollow, generally rectangular structure for installation with a grave containing a casket and having capacity for ease of assembly, said footer including (a) a pair of horizontally spaced vertical side members, said side members each being integral and being spaced apart sufficiently to provide stability for support of a monument, said side members each having upper ends and lower ends, said lower ends terminating at locations close to the bottom of the grave, (c) a pair of vertically spaced horizontal members extending between the two side members and connected, respectively, to the spaced upper ends and the spaced lower ends of said side members, said upper horizontal member comprising a support member disposed closely adjacent a casket located in the grave, (d) said lower horizontal member and one of the vertical side members comprising an integral L-shaped component, and (e) locking means detachably securing the upper end of at least one of the side members to the upper horizontal support member, (f) said locking means comprising engageable complementary male and female elements adapted to provide stability to the footer when the members thereof are assembled.

18. The footer of claim 17, wherein the upper horizontal support member and one of the vertical side members comprise an integral L-shaped component.

19. A stable, multi-component footer for supporting monuments for cemeteries and the like, said footer forming a hollow, generally rectangular structure for installation with a grave containing a casket and having capacity for ease of assembly, said footer including (a) a pair of horizontally spaced vertical side members, said side members each being integral and being spaced apart sufficiently to provide stability for support of a monument, (b) said side members each having spaced upper ends and spaced lower ends, said lower ends terminating at locations above the bottom of the grave, (c) a horizontal support member extending linearly between and overlying the two side members and supported by the spaced upper ends of said side members, said horizontal support member being disposed closely adjacent a casket located in the grave, and (d) a second horizontal member extending between and underlying the two side members and supporting the spaced lower ends of said side members, (e) at least one of said horizontal members and one of said vertical side members comprising an integral L-shaped component.

20. The footer of claim 19, wherein each of said horizontal members is joined integrally to a separate one of the two vertical side members to provide two separate, integral, complemental L-shaped components, one said component being in the form of an inverted L and the other component being in the form of an upright L.

* * * * *